United States Patent [19]

Pearce

[11] 4,211,186

[45] Jul. 8, 1980

[54] FLUIDIZED BED COMBUSTERS

[75] Inventor: Arnold P. Pearce, London, England

[73] Assignee: Flameless Furnaces Limited, London, England

[21] Appl. No.: 901,656

[22] Filed: May 1, 1978

[30] Foreign Application Priority Data

May 2, 1977 [GB] United Kingdom ..... 18354/77

[51] Int. Cl.[2] ..... F22B 1/02

[52] U.S. Cl. ..... 122/4 D; 110/245; 431/170

[58] Field of Search ..... 122/4 D; 110/245; 431/7, 170

[56] References Cited

U.S. PATENT DOCUMENTS 3,625,164 12/1971 Spector ..... 122/4

3,687,115 8/1972 Bell ..... 122/4

3,893,426 7/1975 Bryers ..... 172/4

FOREIGN PATENT DOCUMENTS 858813 1/1961 United Kingdom ..... 110/245

*Primary Examiner*—Edward G. Favors

*Attorney, Agent, or Firm*—Ladas, Parry, Von Gehr, Goldsmith & Deschamps

[57] ABSTRACT

The invention provides a fluidized bed combustion apparatus comprising in a common structure a plurality of modules, each module comprising: a diffuser bed support arranged to support and fluidize a bed of granular material by means of air diffusion into the bed, feed means for supplying material to be burnt to a bed supported on the bed support, and control means for controlling the operation of the bed independently of the operation of the other modules.

21 Claims, 5 Drawing Figures

FLUIDIZED BED COMBUSTERS

BACKGROUND OF THE INVENTION

This invention relates to fluidised bed combustion apparatus and to furnaces and incinerators embodying such equipment. The invention is particularly concerned with provision of large capacity fluidised bed combustion apparatus.

It has been proposed to provide fluidised bed combustion apparatus in which a fluidised bed of granular material is supported in a housing on an air diffuser bed support. In such an arrangement fuel or waste material to be burnt, either to raise heat or for disposal purposes, is fed into the fluidised bed to be burnt therein, the oxygen for combustion coming at least in part and usually entirely from air and into the bed from the diffuser support to fluidise the bed. The diffuser is in some cases arranged to slope from one side of the bed to the other, and the supply of fluidising air to the various areas of the diffuser being selectively controlled to cause the bed materials to circulate about a generally horizontal axis extending across the slope of the diffuser.

It is an object of the present invention to provide a large capacity fluidised bed combuster embodying such principles.

It is a further object to provide a large capacity fluidised bed combuster which is flexible in operation, and the heat output of which can be raised to meet widely varying demands for heat, while still maintaining efficient and effective combustion conditions within the combuster. In the operation of circulating fluidised beds, it is costly and difficult to maintain the circulation of the bed and effective combustion conditions in a large bed when it is desired to burn only an amount of fuel which is small in comparison to the normal capacity of the bed, to produce a small quantity of heat when the demand is below the normal capacity of the plant in which the bed is operating.

SUMMARY OF THE INVENTION

Accordingly the present invention provides a fluidised bed combustion apparatus comprising in a common structure a plurality of modules, each module comprising: a diffuser bed support arranged to support and fluidise a bed of granular material by means of air diffusion into the bed, feed means for supplying material to be burnt to a bed supported on the bed support, and control means for controlling the operation of the bed independently of the operation of the other modules.

Preferably each bed support is arranged to fluidise the bed supported thereon in such manner as to cause it to circulate about a horizontal axis.

BRIEF DESCRIPTION OF THE DRAWINGS

In order to promote a fuller understanding of the above and other aspects of the present invention an embodiment will now be described, by way of example only, with reference to the accompanying drawings in which.

DESCRIPTION OF PREFERRED EMBODIMENTS

Figure 1:
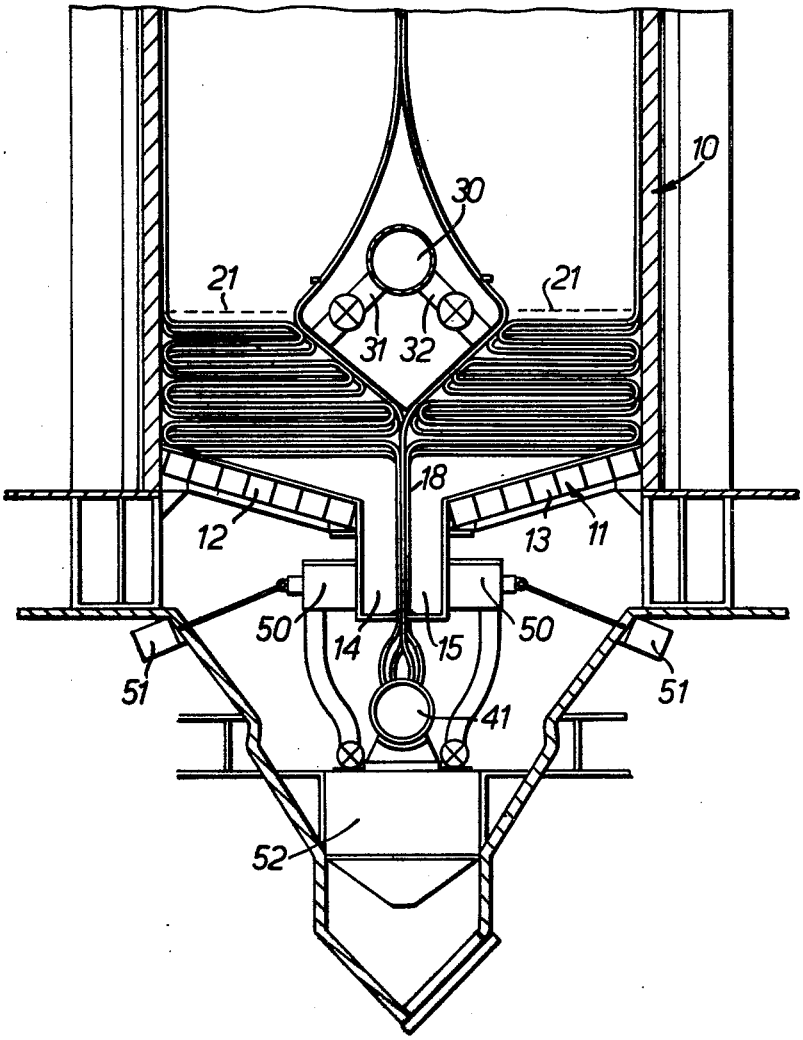
FIG. 1 is a schematic cross-sectional view of a fluidised bed combuster embodying the invention.

FIG. 1 shows a cross-sectional view of a fluidised bed combuster embodied in a steam raising boiler. The boiler comprises a combustion chamber indicated at 10 which is of conventional construction per se embodying suitable fire brick lining to protect the structure from the heat of the combustion, and water tubes are provided inside the walls to extract heat from the combustion gases in known manner per se.

In the base of the housing 10 there is provided a double-sided fluidised bed diffuser support structure indicated generally at 11. The structure 11 comprises two diffuser banks 12 and 13 each arranged to slope downwards and inwardly across the bottom of the housing towards respective ash troughs indicated at 14 and 15.

Figure 2:
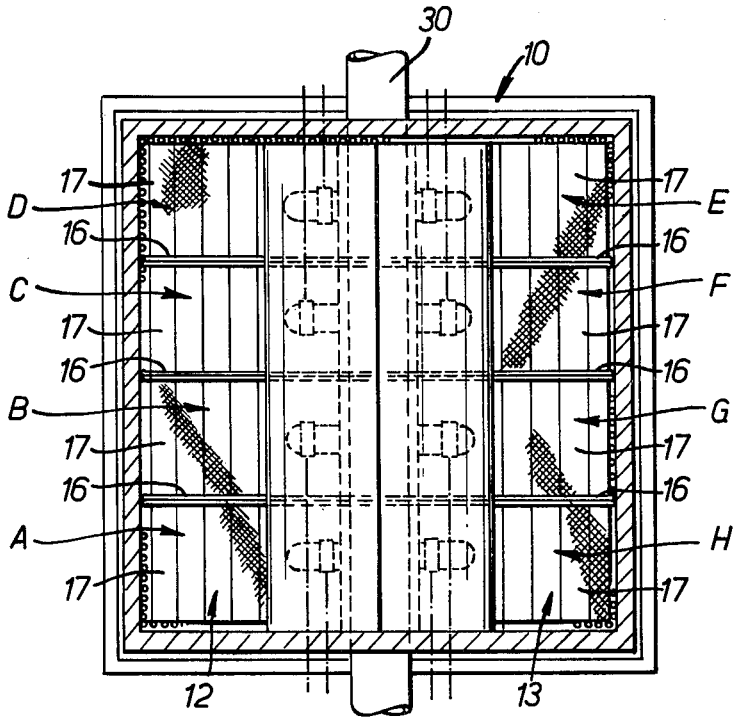
FIG. 2 is a schematic plan view of the combuster of FIG. 1.
Figure 3:
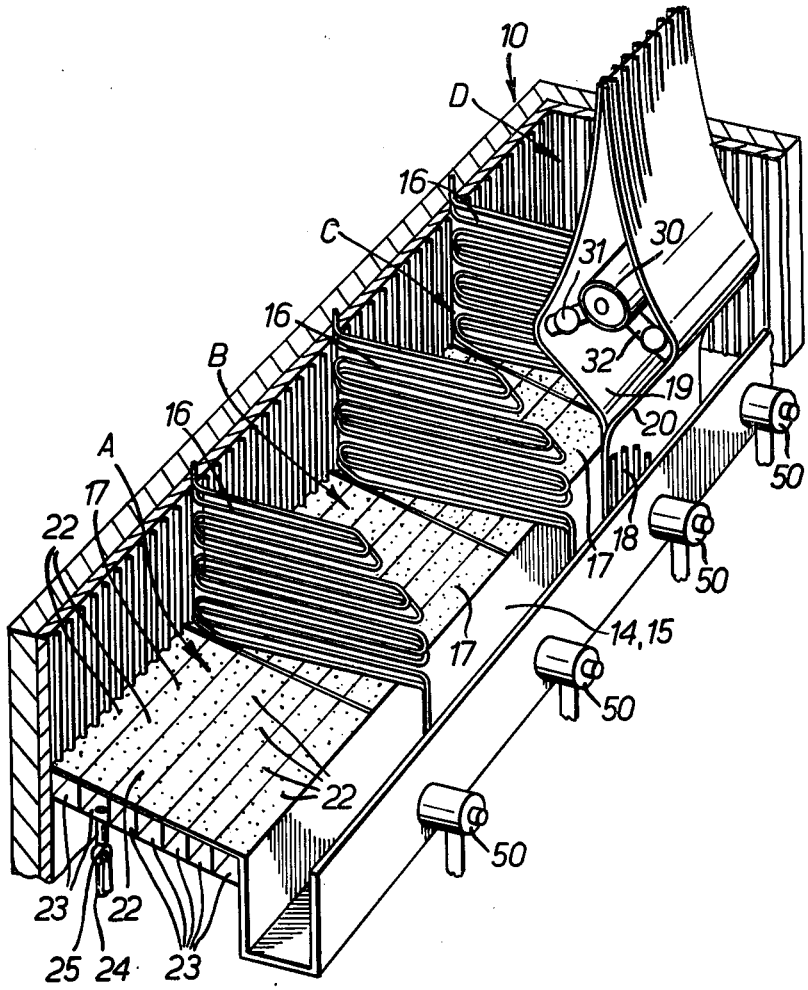
FIG. 3 is a cut away perspective view of the combuster of FIG. 1.

As best seen in FIGS. 2 and 3 each of the banks 12 and 13 is sub-divided by a series of vertical walls 16 so that each of the banks is sub-divided into a series of separate modules each having a diffuser bed support as indicated at 17. The modules are marked in the drawings A, B, C, D, E, F, G and H.

It will be appreciated that the diffuser bed supports 17 may be formed as separate items, or defined as separate areas on the banks 12 and 13 by means of the vertical walls 16 to separate the modules.

A central baffle structure 18 extends vertically through the combuster to separate the ash troughs 14 and 15, and to separate the modules containing fluidised beds formed above the diffusers 17 in the bank 12 and formed above the diffusers 17 in the bank 13. The central baffle structure 18 extends upwards and then outwards over the diffuser banks 12 and 13 with angled baffle portions 19 and 20 as best seen in FIGS. 1 and 3.

In operation of the combuster, the chambers of the modules A, B, C, D, E, F, G and H formed above the diffusers 17 by the baffle structure 18, 19, 20 the dividing walls 16 and the walls of the housing 10 are filled to a level indicated at 21 with suitable sand, aggregate or other granular material, and air is fed into the bed of material through the respective diffuser 17 to fluidise it.

The diffusers 17 making up the banks 12 and 13 are each sub-divided into a plurality of zones indicated at 22 (FIG. 3) each with an associated air duct below the diffuser surface as indicated at 23. Air is supplied to the ducts 23 either from a wind box extending across one end of the diffuser or by individual supply connections as indicated schematically at 24 in FIG. 3, so as to fluidise the bed material above each diffuser 17. Means such as a control valve 25 is provided in each connection 24, for selectively controlling the quantity of air supplied to each duct 23 so the extent to which the material above each zone 22 of a diffuser 17 is fluidised may be controlled. By this means the bed material above each diffuser 17, when it is fluidised may be caused to circulate about a horizontal axis extending into the plane of the drawing in FIG. 1 across the downward slope of the respective diffuser bank 12 or 13. The circulation may be in either direction about this axis, that is to say moving either down the diffuser 17, and up and back under the baffle portion 19, or in the opposite direction according to operational requirements and other circumstances.

In this embodiment material or fuel to be burnt in the combuster is fed to each of the fluidised bed modules by means of a central conduit 30 provided with branch connections 31 and 32 extending through the baffle portions 19 and 20 respectively into the fluidised beds of each of the modules. Fuel or material to be burnt can be conveyed through the conduit 30 into the branches 31 and 32 either pneumatically, or by mechanical means such as screw feeders or conveyor belts. The branches 31 and 32 may also include mechanical fuel means or gravity and/or pneumatic feed may be relied on to carry the material down them into the modules. Individual control valve means is provided in each of the branches 31 and 32 so that the quantity of fuel fed to each of the separate fluidised bed modules may be individually controlled.

The walls of the housing 10 of this embodiment are as mentioned above, lined with water tubes which carry water to be heated in the boiler as a result of combustion in the fluidised bed modules. The vertical separator walls 16 also embody water tubes connected into the water system either as a covering for solid baffles, or, as indicated in the drawings, forming the separator wall structure itself. The central baffle 18 and angled portions 19 and 20 also embody water tubes connected into the system. A central collector header for the tube systems is indicated schematically at 41 and suitable means, not shown, is provided in known manner per se for causing the water to circulate through the tube system extract to extract heat from the combustion to heat the water to raise steam, or for other purposes, and at the same time to cool and protect the structural elements.

The ash troughs 14 and 15 conveniently extend the full length of the respective diffuser banks 12 and 13 although they may be sub-divided to correspond to the bed modules; and are preferably formed with the bottom and side walls embodying air diffusers connected to the fluidising air system so that bed material falling into the ash troughs is fluidised therein. An ash extraction screw auger 50 with associated drive motor 51 is provided in the outside wall of the ash troughs 14 and 15 adjacent each module. The outlets from the extraction augers 50 are lead by suitable conduits to vibrating screen means indicated generally at 52 by which the incombustible ash material is separated from the basic bed material which is inevitably extracted with the ash, the bed material being available for recirculation back into the fluidised bed by suitable means, one of which is discussed in more detail below.

It can be seen that the embodiment provides a large fluidised bed combuster system which is sub-divided into a plurality of modules each of which operates independently of the others. Thus it is possible to establish the circulation of the fluidised bed in each separate module more conveniently and without the problems which would be experienced with attempting to make the equivalent sized bed circulate as a single unit. Further, the combustion conditions can be controlled in each separate module by controlling the amount of fuel and air fuel to it, and the overall heat output of the combuster can be controlled by utilising various numbers of the modules at any given time, and not feeding fuel or indeed fluidising air for combustion to those modules which it is not desired to use.

Again it can be seen that by the provision of a number of modules, construction and maintenance of the whole combuster is simplified in that the modules can be structurally separable; and this maintainable and replaceable as modules, making for easier maintenance and a reduction in "down time" in the event of overhaul of the combuster.

In the above discussion, it will be appreciated that the dividing baffle wall 16 and the central baffle 18 and portions 19 and 20 are in direct contact with the fluidised beds in the modules during combustion and thus receive heat direct from the bed material. Further heat exchange tubes (not shown) may also be positioned in some or all of the module beds, to extend in the central areas of the beds, and connected into the water systems. Consequently the heat output from the individual modules can be varied by adjusting the level 21 of the fluidised bed in the module and thus adjusting the depth of the bed and the amount of the tubular heat exchange structure directly in contact with the bed. In this connection it should be noted that the heat transfer coefficient between fluidised bed material and the tubes in direct contact with it is considerably greater than between the gaseous combustion products above the fluidised bed and the tubes.

Figure 4:
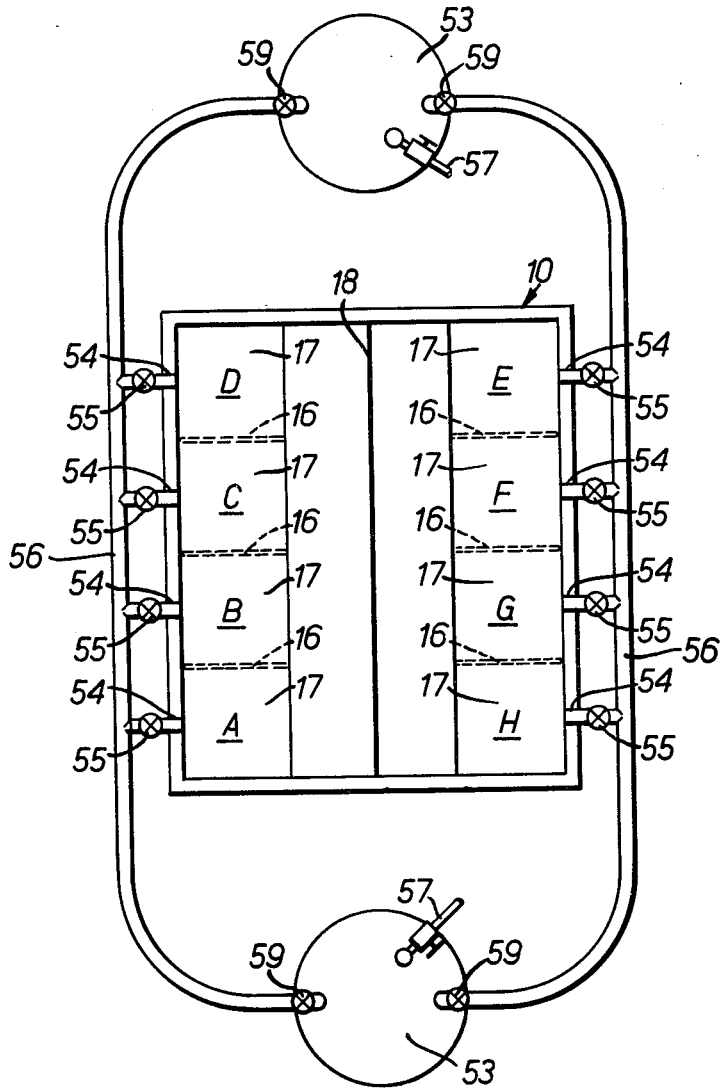
FIG. 4 is a schematic plan view of the beds of the combuster of FIG. 1, showing bed level control means.
Figure 5:
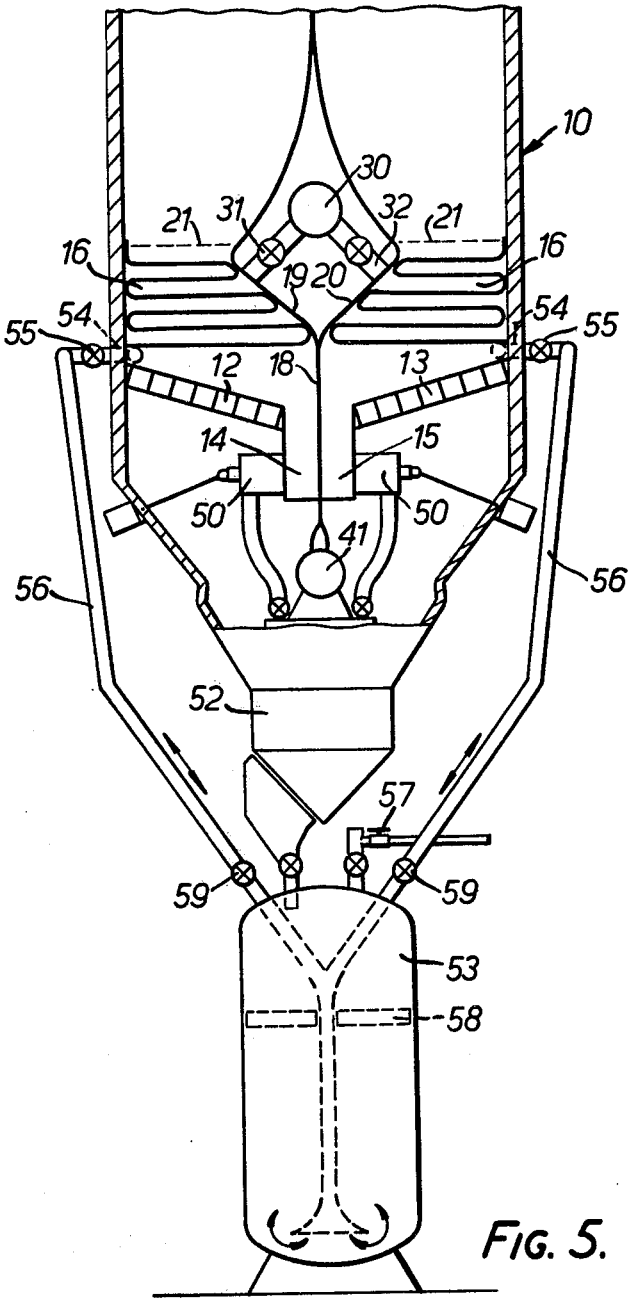
FIG. 5 is a schematic cross-section of the beds of FIG. 4 with the level control means.

FIGS. 4 and 5 show in schematic outline one preferred manner in which the depth of the bed may be controlled. In this arrangement the bed material which is separated from the ash in the screening means 52 is conveyed according to operational needs to two reservoirs 53 for the bed material. In the arrangement shown two reservoirs are provided, although it will be appreciated that one, or more than two can also be used. An inlet 54 with a suitable flow control valve means 55 is provided at the side of the housing 10 immediately above the diffuser 17 of each module. The inlets 54 are connected by suitable ducting 55 to the bottom region of the reservoirs 53. Bed material from the screening means 52 thus collects in the bottom of the reservoirs 53, and means indicated generally at 57 is provided to pressurise the space in the reservoirs above the bed material selectively with air or other fluid. By this means bed material can be forced from the reservoir up through the ducting 56 to the inlets 54. A slack fitting piston 58 is preferably provided in each of the reservoirs 53 to rest on the surface of the bed material therein and to assist in the operation of the device by separating the pressurising air from the bed material. Main outlet valves 59 are preferably provided in the ducting 56 and the ducting and the reservoirs are preferably fully insulated to prevent loss of heat from the bed material which carries with it heat from the combuster.

Thus it can be seen that by controlling the pressurising means 57 the valves 59 and 55, the supply of material to each of the modules can be controlled. Thus as bed material is taken out of a particular module as a result of ashing, the level will drop, and the material can either be replaced to maintain the bed level and thus heat output, or can be allowed to drop by not replacing the material in that module thus reducing the heat output from it. Further it can be arranged by suitable control of the pressurising means 57 for bed material to drop from any or all the modules down through the ducting 56 to the reservoirs 53 to lower the bed even when no ashing takes place, or in the alternative the ash augers may be used to extract and lower the bed material in a module even when it is not necessary at that time to extract ash.

By this means it is possible to control the amount of heat given up to the water tube system and thus the amount of hot water or steam generated, independently of the amount of material fed to the fluidised bed modules for combustion. This is useful where it is desired to incinerate rubbish and thus there is a need for continual combustion of the waste material, but where the demand for hot water or system may be variable.

The control of the heat output from the bed is also useful for controlling the temperature of the bed where the quality of fuel, i.e. calorific value, or the amount of fuel to be fed is variable and it is desired to maintain the bed temperature so that proper combustion conditions may be kept.

What is claimed is:

1. A fluidized bed combustion apparatus comprising in a common structure a plurality of fluidized bed modules arranged side by side in a bank of modules and a plurality of generally vertical walls arranged to separate the bed material of modules in said bank, each such module comprising:

a diffuser bed support arranged to support and fluidize a bed of granular material by means of air diffusion into the bed, feed means for supplying material to be burnt to a bed supported on the bed support, and control means for controlling the operation of the bed independently of the operation of the other modules.

2. Combustion apparatus according to claim 1, wherein means is provided to selectively control the supply of air to each of the diffuser bed supports of the modules whereby each bed supported by a respective support may be fluidised to different degrees in different portions thereof so that it is caused to circulate about a horizontal axis.

3. Combustion apparatus according to claim 2, wherein the diffuser bed support of each module is planar and generally rectangular in plan, structure is provided to mount the support sloping downwards from one edge to the opposite edge, and an ash trough is provided along said opposite edge.

4. Combustion apparatus according to claim 1, wherein the diffuser bed support of each module is planar and generally rectangular in plan, and an ash trough is provided along one edge of the bank of bed supports.

5. Combustion apparatus according to claim 4, including support structure for the diffuser bed support of each module arranged so that the respective bed support slopes downwards towards said one edge from the opposite edge.

6. Combustion apparatus according to claim 4, wherein the ash troughs of the modules are continuous and formed as one trough.

7. Combustion apparatus according to claim 4, wherein the modules are arranged in two banks of modules in said structure.

8. Combustion apparatus according to claim 7, wherein the ash troughs of the modules in each bank are continuous and formed as one trough.

9. Combustion apparatus according to claim 7, wherein the two banks are arranged side by side with the ash troughs of the banks adjacent each other between the banks.

10. Combustion apparats according to claim 1, in which said separating walls each include a heat exchange tubular structure for the extraction of heat from fluidised beds in the modules disposed on each side of the wall.

11. Combustion apparatus according to claim 9, including a central baffle structure disposed between said two banks of modules separating respective modules in the banks.

12. Combustion apparatus according to claim 11 wherein said central baffle structure includes a heat exchange tube structure for the extraction of heat from fluidised beds in the modules.

13. Combustion apparatus according to claim 11 wherein the central baffle structure includes an angled portion on each side thereof extending outwardly over a part of the diffuser bed supports of the respective banks of modules.

14. Combustion apparatus according to claim 11 wherein the ash troughs of the modules of the two banks of modules are formed as a common trough divided by the central baffle structure.

15. Combustion apparatus according to claim 4 wherein the ash trough of said bank includes an ash extraction means.

16. Combustion apparatus according to claim 15 including screening apparatus connected to the ash extraction means of each module and arranged to separate ash from any bed material extracted with the ash, and a reservoir arranged for the collection of the separated bed material.

17. Combustion apparatus according to claim 16 including recirculation means arranged to convey bed material selectively between the reservoir and each module whereby to control the level of the fluidised bed in each module.

18. Combustion apparatus according to claim 16 wherein said reservoir is disposed at a level below the level of the diffuser bed supports of the modules.

19. Combustion apparatus according to claim 16, wherein said recirculation means comprises means for introducing fluid under pressure into the reservoir above bed material therein, and a conduit for bed material leading from the bottom region of the reservoir.

20. Combustion apparatus according to claim 19 wherein said reservoir includes a movable piston arranged to separate bed material therein from the fluid under pressure when introduced therein.

21. Combustion apparatus according to claim 16 including a plurality of such reservoirs for bed material.

* * * * *